US007926313B2

(12) United States Patent
Schenkl et al.

(10) Patent No.: US 7,926,313 B2
(45) Date of Patent: Apr. 19, 2011

(54) DEVICE FOR DETECTING THE UNBALANCE OF A ROTATABLE COMPONENT OF A DOMESTIC APPLIANCE

(75) Inventors: Johann Schenkl, Bodenwöhr (DE); Tony Durfee, Jackson, TN (US)

(73) Assignee: EMZ-Hanauer GmbH & Co., KGAA, Nabburg (DE)

( * ) Notice: Subject to any disclaimer, the term of this patent is extended or adjusted under 35 U.S.C. 154(b) by 1150 days.

(21) Appl. No.: 11/453,691

(22) Filed: Jun. 15, 2006

(65) Prior Publication Data

US 2007/0006619 A1 Jan. 11, 2007

(30) Foreign Application Priority Data

Jun. 17, 2005 (DE) ..... 10 2005 028 253

(51) Int. Cl.
*D06F 37/22* (2006.01)

(52) U.S. Cl. ..... 68/24; 68/58; 68/140

(58) Field of Classification Search ..... 68/12.06, 68/24

See application file for complete search history.

(56) References Cited

U.S. PATENT DOCUMENTS

| | | | | | |
|---|---|---|---|---|---|
| 3,319,741 | A | * | 5/1967 | Hauck | 188/275 |
| 3,350,930 | A | * | 11/1967 | McKirnan | 73/146.3 |
| 3,358,268 | A | * | 12/1967 | Toth | 367/178 |
| 3,662,327 | A | * | 5/1972 | White | 367/181 |
| 4,126,302 | A | * | 11/1978 | Curnutt | 267/221 |
| 4,239,234 | A | * | 12/1980 | Ward | 273/391 |
| 4,991,247 | A | * | 2/1991 | Castwall et al. | 8/158 |
| 6,032,533 | A | * | 3/2000 | Su | 73/579 |
| 6,920,967 | B2 | * | 7/2005 | Wood | 188/380 |
| 2005/0257575 | A1 | * | 11/2005 | Kang et al. | 68/3 SS |

FOREIGN PATENT DOCUMENTS

| | | | |
|---|---|---|---|
| DE | 199 20 870 A1 | | 12/1999 |
| DE | 100 07 839 A1 | | 3/2001 |
| EP | 0 750 065 B1 | | 12/1996 |
| GB | 2 011 021 | * | 7/1979 |
| JP | 02-171420 | * | 7/1990 |
| JP | 03-198871 | * | 8/1991 |
| JP | 09-113349 | * | 5/1997 |
| JP | 11-014445 | * | 1/1999 |
| RU | 636382 | * | 12/1978 |
| RU | 1310544 | * | 5/1987 |

* cited by examiner

*Primary Examiner* — Frankie L Stinson

(74) *Attorney, Agent, or Firm* — John C. Pokotylo; Straub & Pokotylo

(57) ABSTRACT

Device and method for detecting the unbalance of a rotatable component of a domestic appliance, in which device and method a mass, which is movable in dependence on motions of the rotatable component that are caused by unbalance, and/or a spring force which acts upon the mass, and/or a fluidic damping which acts upon the mass, is/are so defined that, above a predefined frequency, movements of the mass are substantially non-dependent on frequency, or frequency-dependent components of movements of the mass are within a predefined range.

24 Claims, 10 Drawing Sheets

DEVICE FOR DETECTING THE UNBALANCE OF A ROTATABLE COMPONENT OF A DOMESTIC APPLIANCE

DOMAIN OF THE INVENTION

The present invention relates in general to a device by which an unbalance of a rotatable component of a domestic appliance such as, for example, a drum of a washing machine or a washer-drier, can be detected.

BACKGROUND OF THE INVENTION

Domestic appliances may have rotatable components whose rotation may give rise to unwanted, irregular motions, particularly in the form of unbalances. This applies, in particular, to rotatable components of domestic appliances which serve to rotate objects for the treatment of which the respective domestic appliance is provided. Examples of such rotatable components are drums of washing machines and washer-driers, and rotary equipment (e.g. rotary plates) in microwave ovens and kitchen stoves.

Unwanted motions resulting from unbalance of rotatable components may occur if, in particular, the mass of objects to be rotated or being rotated in or by means of rotatable components is distributed in a non-uniform manner. A particularly demonstrative example of this is a non-uniform distribution of washing in a drum of a washing machine, which non-uniform distribution, particularly at high rotational speeds of the drum (e.g. in spinning), may give rise to unbalances and, resulting therefrom, unwanted motions of the drum.

For the domain of washing machines, the practice of detecting the unbalance of the drum is known in the art. Known approaches use mass-and-spring systems, wherein motions caused by unbalance of the washing-machine drum are detected. In such cases, the resonant frequency of the mass-and-spring system is usually so set that the mass-and-spring system is brought into resonant vibration when motions of the washing-machine drum that are generated by unbalance attain a predefined quantity, cf. EP 0 750 065 A1. This approach, however, does not permit precise detection of unwanted motions of the washing-machine drum that result from unbalance, as would be desirable for an optimized control of the rotation of the washing-machine drum.

Furthermore, known approaches are disadvantageous in so far as they use elaborate systems or methods to deduce motions of the washing-machine drum from movements of the mass of the mass-and-spring system.

DE 199 20 870 A1 describes a washing machine which permits measurement of the weight of the washing. For this purpose, a pressure that is dependent on the weight of the washing is measured and converted into a weight. DE 100 07 839 A1 describes a vibration detector device having a coil whose core is movable by reason of vibration and thereby alters the inductance of the coil.

OBJECT OF THE INVENTION

The object of the present invention is to detect in a more precise and simple manner motions of a rotatable component of a domestic appliance that are caused by unbalance.

SUMMARY OF THE INVENTION

To achieve this object, the present invention provides a device for detecting motions of a rotatable component of a domestic appliance that are caused by unbalance, and a domestic appliance comprising such a device, according to the independent claims.

The device according to the invention has a housing, a mass which is movable in the housing in dependence on motions of the rotatable component that are caused by unbalance, a spring arrangement by which, in the idle state (i.e. when the rotatable component is not rotating or is not unbalanced), the mass is held in an initial position, and a fluidic damping which acts upon the mass in order to damp movements of the mass out of the initial position.

In this case the spring arrangement and/or the mass and/or the damping is/are so designed that, above a predefined frequency of motions of the rotatable component that are caused by unbalance of said component, movements of the mass out of the initial position are substantially non-dependent on frequency, or frequency-dependent components of such movements of the mass are within a predefined range, i.e. do not exceed a certain quantity.

Since movements of the mass out of the initial position, in particular the amplitude of such movements, are substantially non-dependent on the current frequency of motions of the rotatable component that are caused by unbalance, or frequency-dependent components of the movement of the mass are minimized to a predefined range, there ensues a substantially linear relationship between movements of the mass and motions of the rotatable component that are due to unbalance of said component. The use of elaborate devices and/or methods to deduce unbalance-related motions of the rotatable component from movements of the mass is avoided.

A further result is that motions of the rotatable component that are related to unbalance of said component can be detected with precision, particularly since, in the case of the device according to the invention, movements of the mass that are caused by resonance, if they occur at all, can be defined within a range of motions of the rotatable component that are caused by unbalance, said range being able to be classified as non-critical, or as being of lesser or no interest, for the operation of the domestic appliance or for rotations of the rotatable component. Thus, for example, the device according to the invention allows movements of the mass that are caused by resonance to be displaced into a frequency range of motions of the rotatable component that are caused by unbalance wherein said frequency range corresponds to low rotational speeds. Motions of the rotatable component that are caused by unbalance of said component and are below the predefined frequency can be determined by the use of other devices for unbalance determination such as, for example, by the use of approaches dependent on rotational speed. In addition, or alternatively, this can be achieved through one or more further devices, according to the invention, having a lesser predefined frequency.

For reasons of simplification, the following relates to movements of the mass that are substantially non-dependent on frequency. Statements relating thereto apply accordingly if frequency-dependent components of movements of the mass are limited to the predefined range.

In order to define, and in particular to enlarge, the range within which movements of the mass are substantially non-dependent on frequency, provision is made whereby a mass having a predefined form is used and the form is so defined or designed that the movements of the mass that are substantially non-dependent on frequency occur in a predefined frequency range of motions of the rotatable component that are caused by unbalance.

In addition, or alternatively, this can be achieved in that there is provided between the mass and a side wall of the housing, said side wall extending substantially in parallel to possible directions of movement of the mass, a clearance which is of such dimensions that the movements of the mass that are substantially non-dependent on frequency occur in the predefined frequency range of motions of the rotatable component that are caused by unbalance.

In the case of a preferred embodiment, the frequency predefined for the device is a resonant frequency of the system comprised of spring arrangement, mass and damping.

The device according to the invention preferably comprises a motion detection unit, in order to detect movements of the mass.

The motion detection unit may comprise a pressure sensor arrangement. Provision is made in this case whereby movements of the mass cause pressure variations which are detected by the pressure sensor arrangement and are then used to deduce motions of the rotatable component that are caused by unbalance.

The motion detection unit may (also) comprise an optical sensor arrangement, in order to detect movements of the mass by optical means. The optical sensor arrangement may have, for example, a plurality of discretely disposed photoelectric sensors which are preferably closely positioned and which respectively detect a current position of the mass and render possible propositions concerning movements of the mass when a positional variation of the mass is ascertained. The optical sensor arrangement may also detect movements of the mass by means of reflection time measurement, by use of a measuring beam directed on to the mass and reflected by same. The optical motion detection may also be effected by means of absorption measurement and/or transmission measurement. In this case provision is made, for example, whereby the mass is realized as partially transparent and partially non-transparent, e.g. in the form of a metal body covered with plastic.

The motion detection unit may (also) have an electromagnetic sensor arrangement in order to detect movements of the mass by electromagnetic means, i.e. on the basis of interactions of the mass with an electric and/or magnetic field. In this case provision is made, for example, whereby the mass is produced from an at least partially magnetic material and the housing is provided with a coil which extends substantially in parallel to possible directions of movement of the mass and generates a magnetic field. Furthermore, provision is made whereby movements of the mass are detected with the use of one or more Hall sensors. Capacitive measurements may also be used for electromagnetic motion detection.

According to an embodiment, provision is made whereby the fluidic damping is disposed between a first side of the mass and a first, closed end of the housing, said end being opposite the first side of the mass.

If the device has a pressure sensor arrangement, provision is made, according to a further embodiment, whereby the pressure sensor arrangement is disposed such that it is fluidically connected to a first, open end of the housing, and the fluidic damping is disposed between a first side of the mass, which side is opposite the first end of the housing, and an input side of the pressure sensor arrangement.

It is possible in this case for the input side of the pressure sensor arrangement to be connected to the first end of the housing via a fluid line.

Alternatively, provision is made in this case whereby the pressure sensor arrangement is disposed directly on the first end of the housing.

The fluidic damping preferably comprises at least one predefined gas or a predefined gas mixture. This makes it possible, for example, for the damping characteristics of the fluidic damping to be so defined that the movements of the mass that are substantially non-dependent on frequency, mentioned at the outset, are achieved.

Instead of one or more gases, a predefined fluid or fluid mixture may be used for the fluidic damping.

According to an embodiment, the housing is open at a second end. This embodiment is preferred if, in particular, the fluidic damping is achieved by means of one or more gases (e.g. air).

Provision is made in this case whereby the second end of the housing is designed to be connected to a line of the domestic appliance, said line carrying fluid at least partially and/or at least temporarily. This embodiment makes it possible, for example, for the device according to the invention to be connected to a rising line of a washing machine, or for the device according to the invention to be integrated into a rising line of a washing machine, for example above an air trap provided therein.

The spring arrangement may comprise a first spring, which is disposed between a side of the mass and an end of the housing, said end being opposite said side.

This embodiment may be compared to a pendulum-like arrangement of the mass and spring.

The spring arrangement may furthermore comprise a second spring, which is disposed between the other side of the mass and the other end of the housing.

Particularly in the case of embodiments in which the spring arrangement comprises only a first spring, provision is made whereby the first spring is fixed to the mass. If the second spring is also used in this case, the second spring may likewise be fixed to the mass, or cooperate non-positively with the latter.

Particularly in the case of embodiments in which the spring arrangement has the first spring and the second spring, provision is made whereby the mass is held between the first and second springs by non-positive closure.

In the case of a further embodiment, the spring arrangement may comprise a spring which extends substantially fully through the housing in the direction of movement of the mass, the mass being disposed in the spring, for example between individual spring coils or a plurality of spring coils.

The spring arrangement is preferably biased in the idle state, in order to hold the mass biased in the initial position. In particular, a defined initial position is thereby achieved.

The domestic appliance according to the invention has a rotatable drum and the device according to the invention in one of the embodiments described above.

In particular, provision is made whereby the domestic appliance is a washing machine and the device according to the invention is connected to a rising line of the washing machine or constitutes a part of the rising line.

In this case, provision is made whereby movements of the mass out of the initial position are detected through pressure variations caused thereby. A pressure detection device of the washing machine may be used concomitantly to detect such pressure variations. If the device according to the invention has a pressure detection arrangement, said pressure detection arrangement may also be used to detect pressures prevailing in the washing machine in order, for example, to detect the level of liquid in the drum.

Irrespective of whether the device according to the invention is used in combination with a rising line, provision is made whereby the device according to the invention is attached to a component of the domestic appliance, which component can be acted upon by forces, if present, generated by motions of the drum that are caused by unbalance.

In the case of the method according to the invention, a predefined frequency of motions of the rotatable component that are caused by unbalance is defined, and a mass, which is movable in dependence on motions of the rotatable component that are caused by unbalance, and/or at least one spring force which acts upon the mass, and/or a fluidic damping which acts upon the mass, is/are defined in such a way that, above the predefined frequency, movements of the mass are substantially non-dependent on frequency or, if present, frequency-dependent components of movements of the mass are within a predefined range, i.e. they do not exceed predefined limiting values.

Preferably the mass is so designed that, for a predefined frequency range of motions of the rotatable component that are caused by unbalance, the movements of the mass are substantially non-dependent on frequency, or the frequency-dependent components of movements of the mass are within the predefined range.

Alternatively, or in addition, if the mass is movable in a housing, a clearance between the mass and a side wall of the housing, said side wall extending substantially in parallel to directions of movements of the mass, may be so designed that, for a predefined frequency range of motions of the component of the domestic appliance that are caused by unbalance, movements of the mass are substantially non-dependent on frequency, or the frequency-dependent components of movements of the mass are within the predefined range.

A resonant frequency of the system comprised of spring arrangement, mass and damping is preferably defined for the predefined frequency.

Furthermore, movements of the mass may be detected.

In this case provision is made whereby movements of the mass are detected through detection of pressure variations caused thereby, it being possible, for the purpose of detecting the pressure variations, to detect forces which are caused by movements of the mass and act upon the fluidic damping.

Movements of the mass may (also) be detected optically and/or electromagnetically.

BRIEF DESCRIPTION OF THE DRAWINGS

The following description makes reference to the appended drawings, wherein.

DESCRIPTION OF PREFERRED EMBODIMENTS

For the purpose of illustrating the present invention and describing preferred embodiments, the following takes as a basis a domestic appliance in the form of a washing machine having, as a rotatable component, a drum for which motions caused by unbalance are to be detected.

Figure 1:
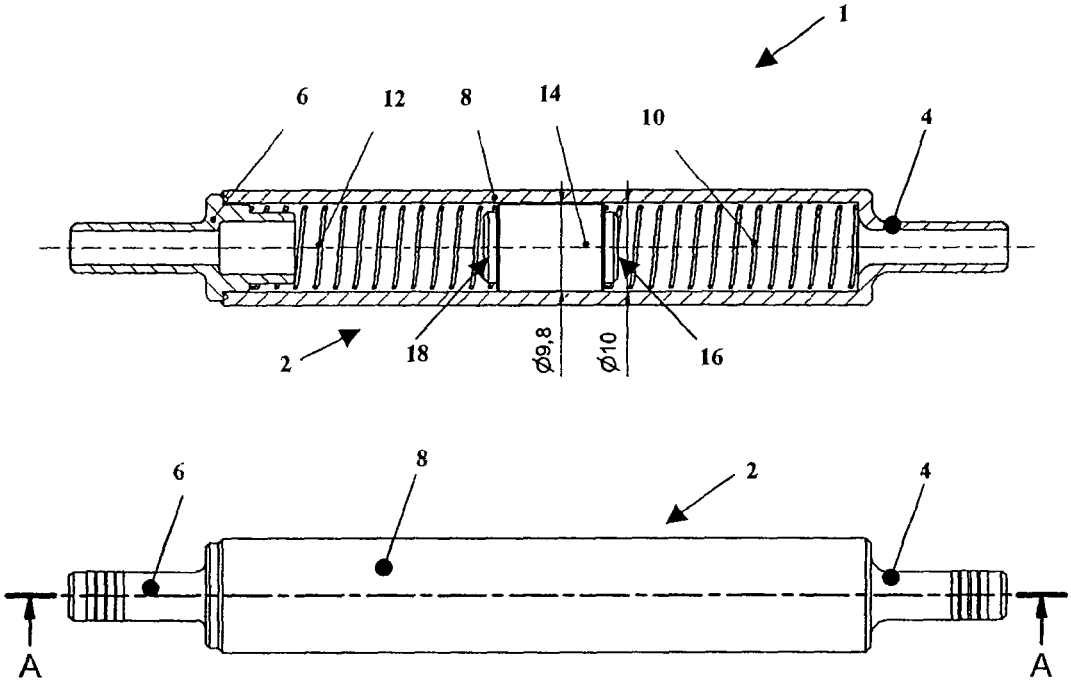
FIG. 1 shows schematic representations of an embodiment of the device according to the invention.

FIG. 1 shows an embodiment of a device 1 for detecting motions of the washing machine drum that are caused by unbalance. The device comprises a housing 2 having a first end 4 and a second end 6. The first end 4 is realized as a single piece with the housing 2. The second end 6 is constituted by a separate component. Notwithstanding FIG. 1, the first end 4 may be realized as a separate component. In order to attach the separate component(s), provision is made whereby screwed, bonded, slip, welded and/or soldered connections are used.

A tapering transition between a main body 8 of the housing 2 and the first end 4 constitutes a stop or a counter-bearing for a first spring 10. A second spring 12 abuts on the screw-in component constituting the second end 6.

A mass 14 is disposed between the first spring 10 and the second spring 12, the first spring 10 abutting on a first side 16 of the mass 14 and the second spring 12 abutting on a second side 18 of the mass 14. The first spring 10 and the second spring 12 constitute a spring arrangement which, preferably with biasing of at least one of the springs 10 and 12, in the idle state shown in FIG. 1 holds the mass 14 in an initial position.

The initial position of the mass 14 relative to the housing and, if present, forces of the first spring 10 and/or of the second spring 12 acting upon the mass 14 may be defined by the spring constants and/or by the screw-in component constituting the second end 6.

Notwithstanding the embodiment shown in FIG. 1, it is possible to use only the first spring 10 or only the second spring 12 for the spring arrangement. If only one of the springs 10 and 12 is used, it is advantageous if the mass 14 is connected to the spring by the respective side 16 or 18.

The mass 14 shown in FIG. 1 is cylindrical in form with, apart from the regions provided for abutment of the springs 10 and 12, a substantially constant, circular diameter or cross-section. The outer diameter of the mass 14 and the inner diameter of the housing main body 8 differ, such that a clearance 20 is provided between the mass 14 and the inside of the housing main body 8. The dimensioning of the clearance 20, or of the outer diameter of the mass 14 and/or of the inner diameter of the housing main body 8, is described in greater detail in the following.

Figure 2:
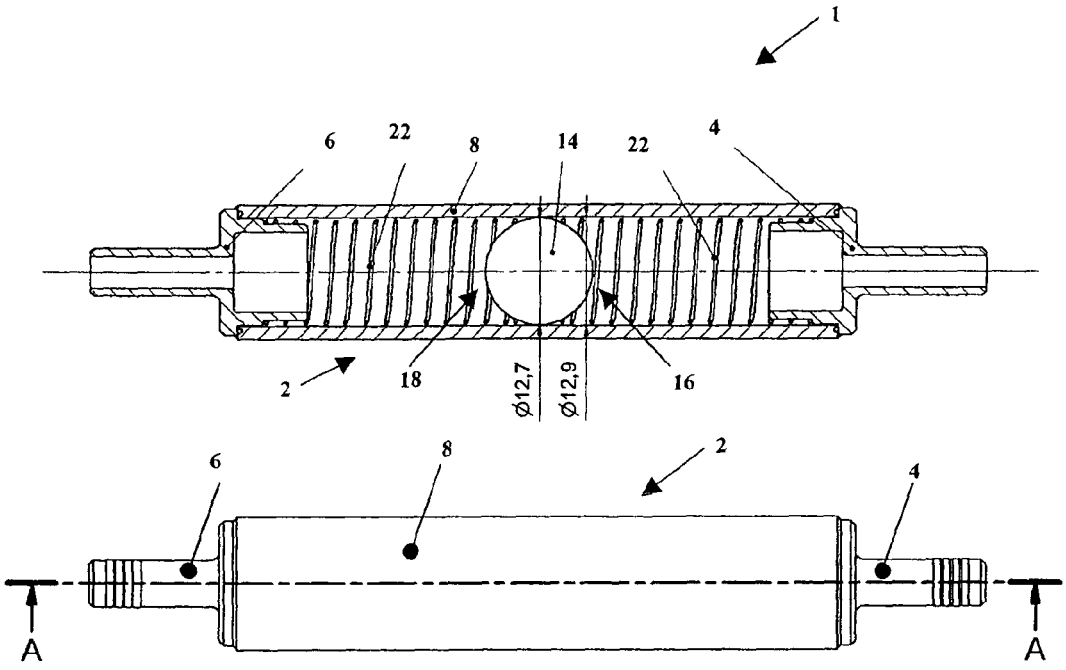
FIG. 2 shows schematic representations of a further embodiment of the device according to the invention.

The embodiment shown in FIG. 2 differs from the embodiment of FIG. 1 in that both the first end 4 and the second end 6 are constituted by screw-in components. A further difference is that in this case the spring arrangement comprises a spring 22 which extends substantially fully through the housing main body 8 and which abuts on the first end 4 and on the second end 6.

In the case of this embodiment, the mass 14 is disposed in the spring 22 or, more precisely, clamped between coils of the spring 22.

Furthermore in the case of this embodiment, the mass 14 is spherical. The outer diameter of the mass 14 and the inner diameter of the housing main body 8 differ, such that a clearance 20 is likewise provided between the outside of the mass 14 and the inside of the housing main body 8.

Notwithstanding the embodiments represented, in the case of the embodiment of FIG. 1 the mass 14 may be spherical and/or, in the case of the embodiment of FIG. 2, the mass 14 may be cylindrical in form.

Figure 3:
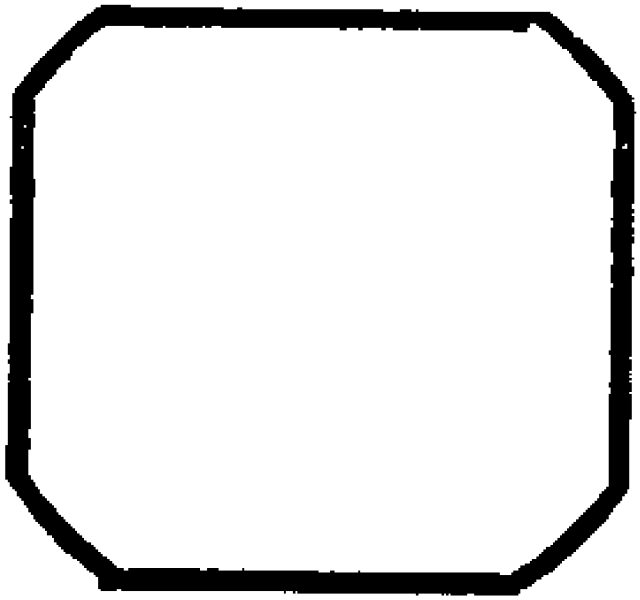
FIG. 3 shows a schematic cross-sectional representation of an embodiment of a mass provided in the case of the device according to the invention.

FIG. 3 shows a cross-sectional representation of a further embodiment of a mass that may be used in the case of the device according to the invention. This embodiment has a cross-section which is substantially rectangular in form, but with rounded corners. Also [possible] are embodiments of the mass which are polygonal in cross-section (e.g. five-sided, six-sided, . . . -sided), but likewise with rounded corners. The rounded corners serve the purpose of guidance in the housing main body. The regions of the mass extending between the rounded corners, together with the inside of the housing main body, provide for the clearance described above.

Figure 4:
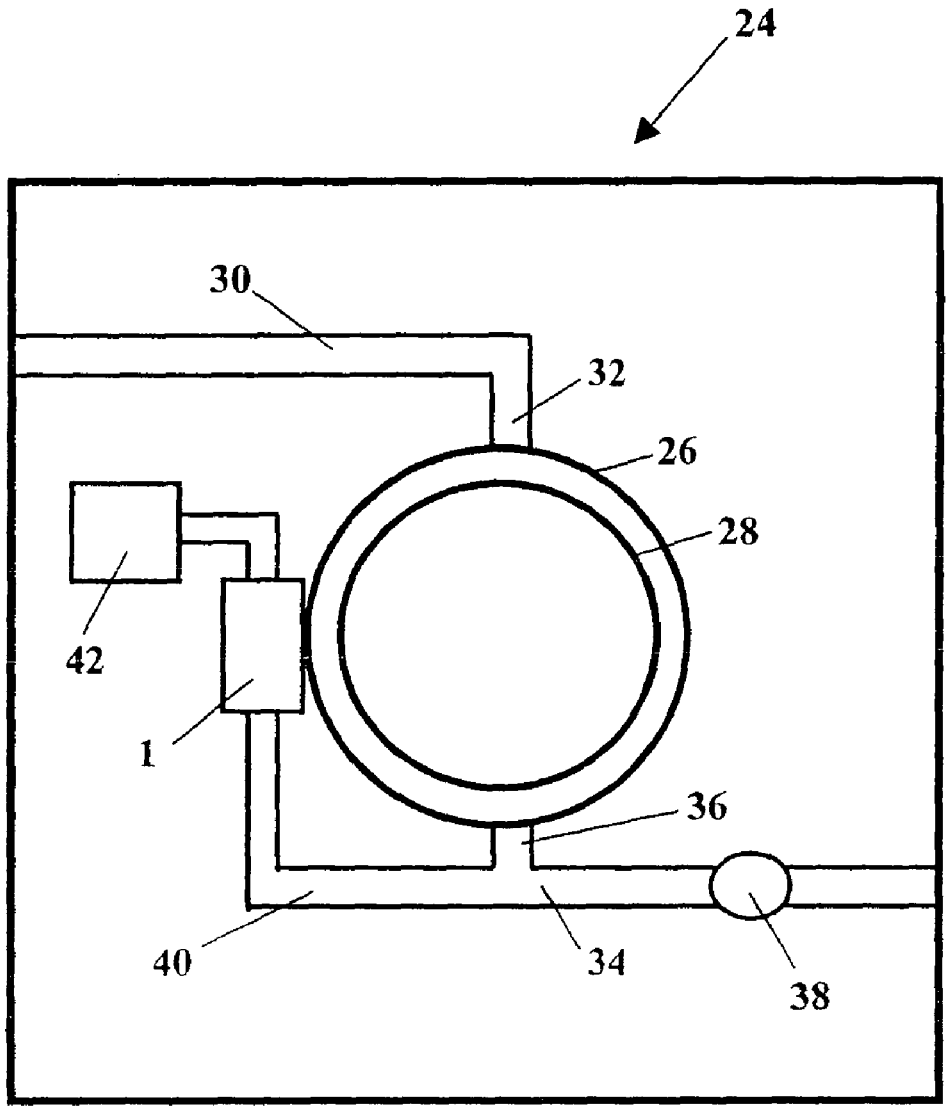
FIG. 4 shows a schematic representation of a use, in a washing machine, of the device according to the invention.

FIG. 4 is a schematic illustration of a possible arrangement, in a washing machine, of the device according to the invention. The washing machine, denoted as a whole by the reference 24, has a drum 28 which is rotatably disposed in a solution container 26. On its top side, the solution container 26 has an intake 32 which is connected to a fresh-water line 30 and through which water can be supplied to the solution container 26 and the drum 28. On its underside, the solution container 26 has an outlet 36 which is connected to a waste-water line 34 and through which liquid can be removed from the drum 28 and from the solution container 26 by means of a pump 38.

The outlet 36 is additionally connected to a line 40, designated as a rising line. The device 1 is connected to the end of the rising line 40 that is opposite the rising-line end connected to the outlet 36. In the following, it is taken as a basis that the second end 6 of the housing 2 is connected to the rising line 40. At the opposite end of the device, i.e. in this case the first end 4 of the housing 2, a pressure sensor arrangement 42 is fluidically connected to the interior of the housing 2.

The pressure sensor arrangement 42 can be used to detect the current level of liquid in the solution container 26, or drum 28, and motions of the drum 28 caused by unbalance.

According to the current level of liquid in the solution container 26 and in dependence on variations of said level, a level of liquid occurs, and varies, respectively, in the rising line 40. Forces, which act upon air between the liquid, present in the rising line 40, and the pressure sensor arrangement 42 are produced in dependence on the level of liquid and its variations in the rising line.

Pressures and pressure variations resulting therefrom are detected by the pressure sensor arrangement 42 and used to deduce the current level of liquid and its variation in the solution container 26.

In an operation of the washing machine 24 in which the pressure sensor arrangement 42 is used to detect the level of liquid in the solution container 26, pressures acting between the pressure sensor arrangement 42 and liquid present in the rising line 40 vary in such a way that an equalization of pressure can occur between the first and second sides 16 and 18 of the mass 14.

If washing is distributed in a non-uniform manner in the drum 28, upon rotations of the drum 28 unwanted motions of the drum 28 may occur as a result of unbalance, said motions, in turn, transmitting unwanted forces to further components (not shown) of the washing machine 24. In order to prevent this, it is desirable to identify motions of the drum 28 that are caused by unbalance, in order to counter said motions through a corresponding control of the drum 28, particularly of its rotational speed (e.g. reduced rotational speed and/or redistribution of washing in the drum through appropriate rotary motions). In order to transfer to the device 1 forces which are transferred to further components of the washing machine 24 through unwanted motions of the drum 28, the device 1 is directly or indirectly connected or attached to one or more components of the washing machine 24 upon which such forces can act. For example, the device 1 is attached to the outside of the solution container 26.

If, upon rotation of the drum 28, unwanted motions of said drum occur as a result of unbalance, forces resulting therefrom are transmitted to the housing 2. Owing to the inertia of the mass 14 relative to the housing 2, the mass 14 moves within the housing 2. Such movements of the mass 14 effect pressure variations in the space between the pressure sensor arrangement 42 and the side of the mass 14 opposite to said pressure sensor arrangement, i.e. in this case, the first side 16 of the mass 14. The pressure variations are detected by the pressure sensor arrangement 42 and, as described in greater detail in the following, used to identify unwanted motions of the drum 28 that are caused by unbalance.

Figure 5:
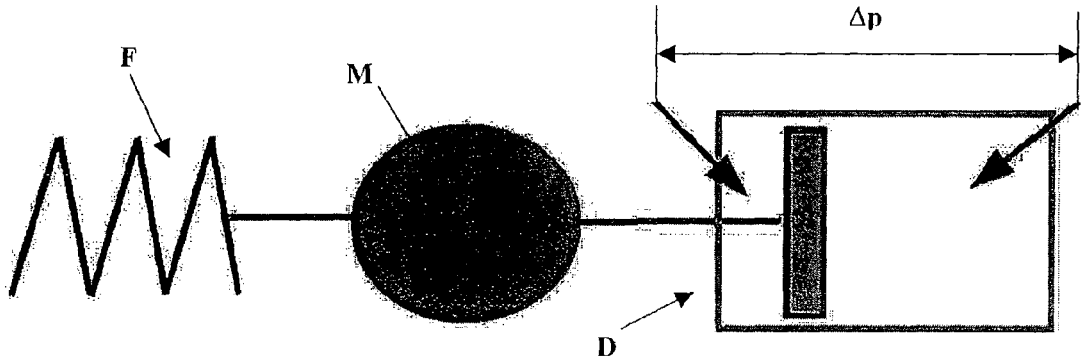
FIG. 5 shows a schematic representation of a system comprised of spring arrangement, mass and damping of the present invention.

FIG. 5 is a schematic illustration of relationships used in the case of the device 1. The device 1 may be considered ideally as a system having a spring arrangement F, a mass M and a fluidic damping D. In the case of the embodiments of FIGS. 1 and 2, the springs 10, 12 and the spring 22 constitute the spring arrangement F and the mass 14 constitutes the mass M. If the embodiments of FIGS. 1 and 2 are used as in FIG. 4, the damping D is provided by air present between the pressure sensor arrangement 42 and the mass 14.

Upon movements of the mass M, forces act both between the mass M and the spring arrangement F, and between the mass M and the damping D. Forces of the mass M acting upon the damping D result in pressure variations on the side of the damping D that is distant from the mass M. These pressure variations may be described by the following equation:

$$\Delta\rho=-C/m\cdot x-K\cdot x'+x'', \text{ wherein}$$

$\Delta\rho$ is a pressure variation,

C is the spring constant of the spring arrangement F, m is the mass of the mass M, x denotes the quantity of a movement of the mass M from its initial position, it being taken as a basis according to FIG. 5 that movements of the mass M to the left result in a positive x, whereas movements of the mass to the right result in a negative x, x' denotes the velocity of the mass M, K denotes the damping constant of the damping D, and X" denotes the acceleration of the mass M.

The resonant frequency of the system comprised of spring arrangement, mass and damping is defined, in essence, by the ratio of spring constant of the spring arrangement F and mass of the mass M (C/m). The resonant frequency is advantageously so defined that it lies in a lower end of a frequency range of unwanted motions of a washing machine drum that are caused by unbalance. The resonant frequency may also be concomitantly determined by the damping D, in dependence on a damping constant K used for the damping D.

Figure 6:
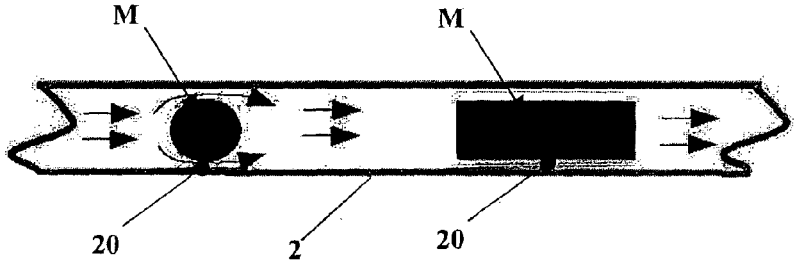
FIG. 6 shows schematic representations for the purpose of explaining influences of dimensions of the mass and/or of the housing of the device according to the invention.

Furthermore, use is made of relationships which, in the case of movements of the mass M, relate to air movements through the clearance between the mass M and the housing. As illustrated in FIG. 6, air movements through the clearance between the mass M and the housing depend on the size of the clearance and the form of the mass. Pressure variations caused by the system constituted by the spring arrangement, mass and damping can be influenced through the size of the clearance and/or through the form of the mass M. In particular, pressure variations above the resonant frequency are influenced by these parameters, maximum pressure amplitudes and/or a range being definable in that pressure variations caused by movements of the mass M are substantially non-dependent on frequencies of unwanted motions of the washing machine drum that are generated by unbalance, or, if frequency-dependent movement components of the mass M occur, they do not exceed a predefined quantity.

Figure 7:
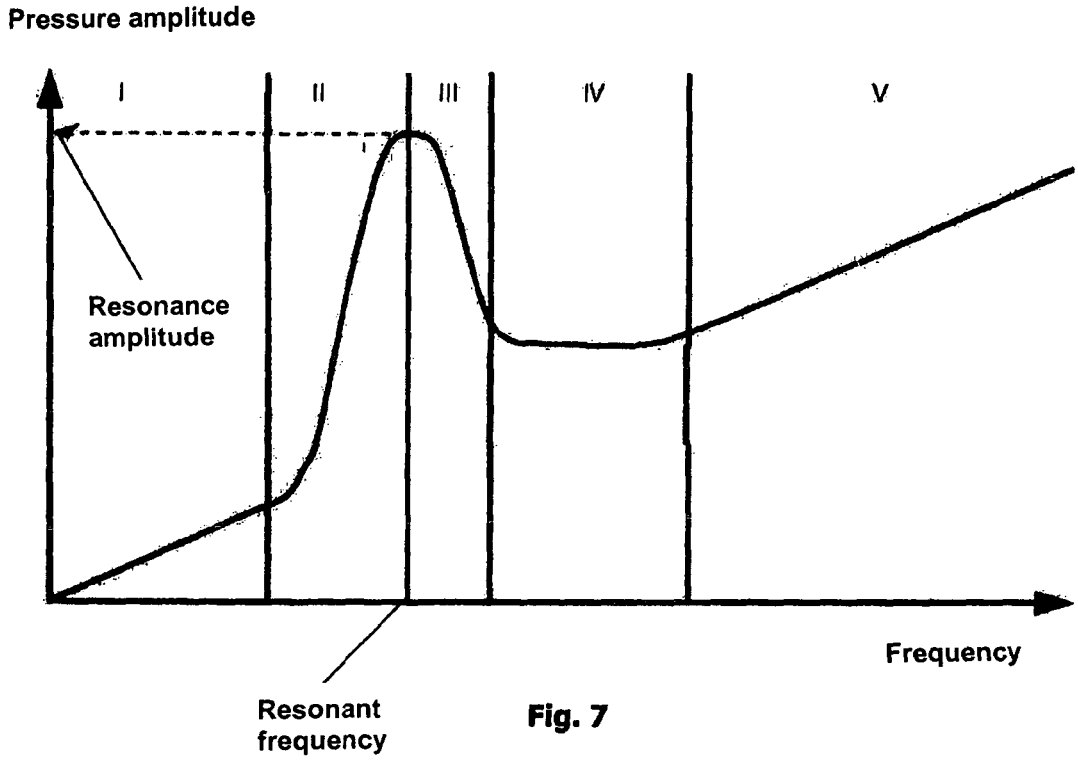
FIG. 7 shows an idealized schematic curve representation of relationships of, on the one hand, frequencies of motions of a rotatable component of a domestic appliance that are caused by unbalance and, on the other hand, movements of the mass of the device according to the invention.

FIG. 7 illustrates schematically the frequency response of the system comprised of spring arrangement, mass and damping, on the basis of motions of the washing machine drum caused by unbalance. In the range I, the mass M does not move, or moves only by an insignificant amount. No pressure variations, or only insignificant pressure variations, result therefrom. In the range II, the mass M moves as far as a maximum displacement MA defined by the resonant frequency. As the frequency of motions of the washing machine drum increases in the range II, the damping-side pressure also increases.

In the range III, following exceeding of the resonant frequency the movements of the mass M become smaller in dependence on frequency. The damping-side pressure thus drops.

As shown by FIG. 7, movements of the mass M in the ranges II and III, and pressures and pressure variations resulting therefrom, are highly dependent on frequency.

In contrast thereto, movements of the mass M in the subsequent range IV are almost non-dependent on frequency. Rather, movements of the mass M at frequencies in the range IV can be regarded as having a linear relationship to motions of the washing machine drum that are caused by unbalance. Consequently, measurements which permit propositions concerning the unbalance of the washing drum are advantageously performed in the range IV. As stated above, the magnitude of the range IV may be set through the clearance 20 and/or the form of the mass M. The position of the range IV may be defined through the resonant frequency. Provision is made in this case whereby the resonant frequency is so predefined that it is as small as possible and/or corresponds to a frequency of motions of the washing machine drum that are caused by unbalance, at which frequency unwanted effects on the washing machine are not expected.

In the range V, movements of the mass M increase in dependence on frequency. This is due, in particular, to the fact that at higher frequencies the damping constant of the damping D varies, because the air current through the clearance 20 is reduced and the damping-side air becomes more and more compressed. The pressure in this case varies in dependence on frequency.

Figure 8:
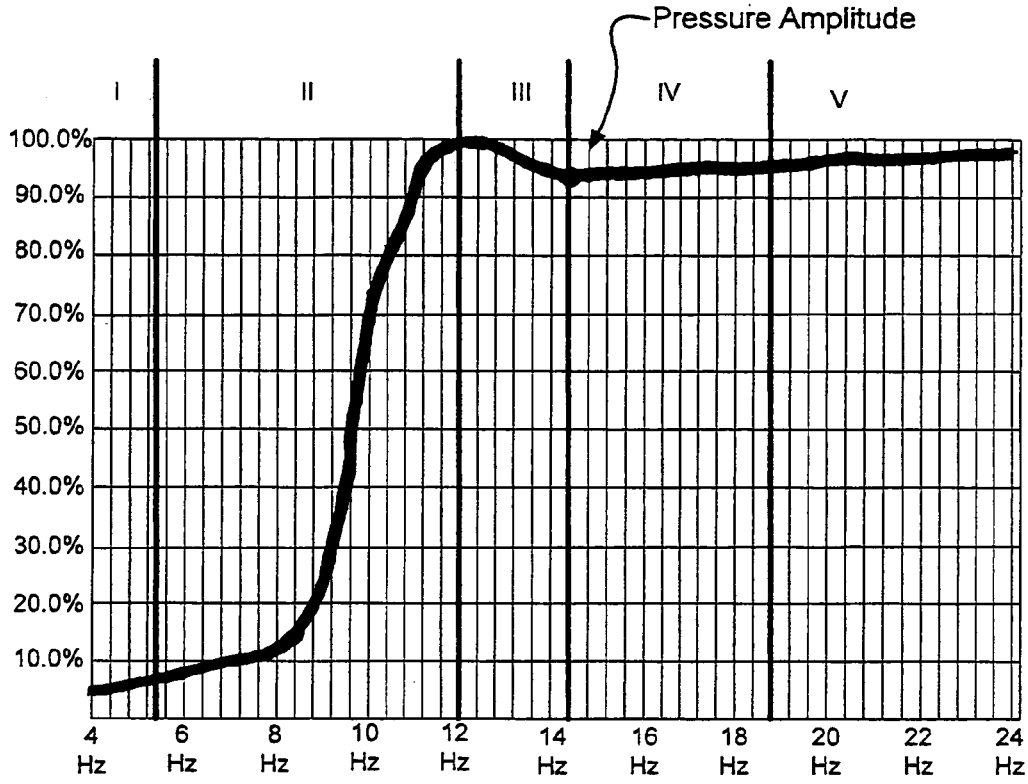
FIG. 8 shows a curve representation, based on measurements, of relationships of, on the one hand, frequencies of motions of a rotatable component of a domestic appliance that are caused by unbalance and, on the other hand, movements of the mass of the device according to the invention.
Figure 9:
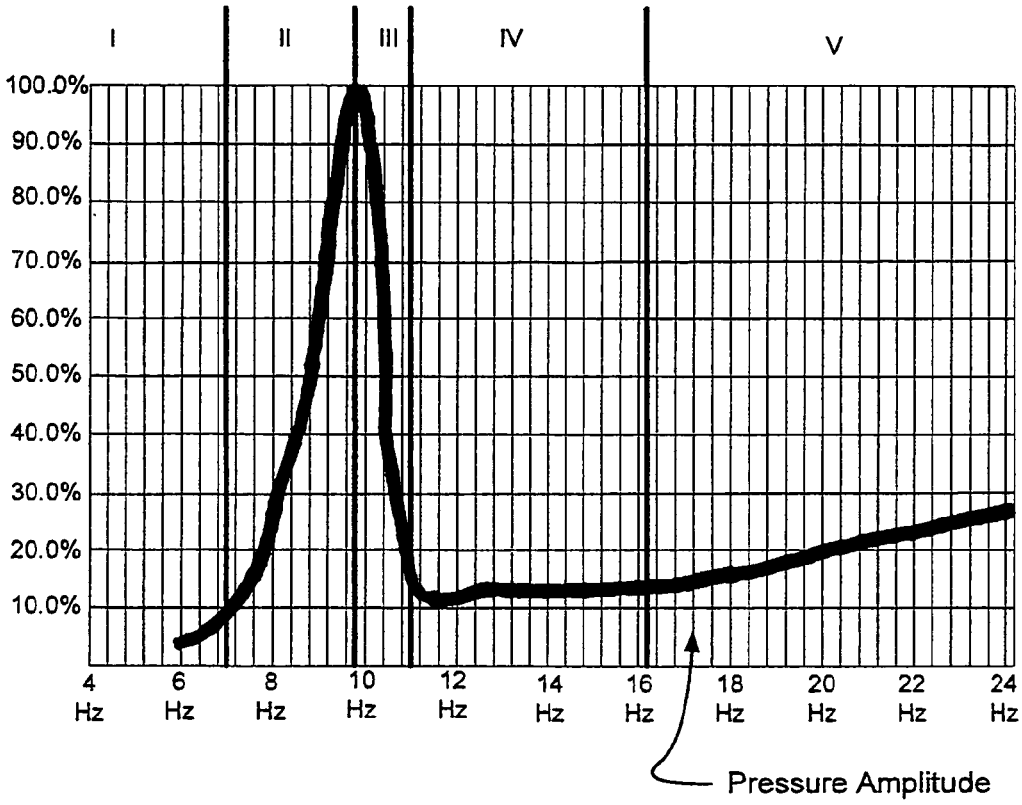
FIG. 9 shows a further curve representation, based on measurements, of relationships of, on the one hand, frequencies of motions of a rotatable component of a domestic appliance that are caused by unbalance and, on the other hand, movements of the mass of the device according to the invention.

FIGS. 8 and 9 show curves indicating pressure variations in dependence on frequencies of motions of the washing machine drum that are caused by unbalance. In the case of the curve shown in FIG. 8, a spherical mass and a ratio of 1.01 between the housing inner diameter and the ball diameter were used. In the case of the curve shown in FIG. 9, a cylindrical mass and a ratio of 1.11 between the housing inner diameter and the cylinder diameter were used.

Figure 10:
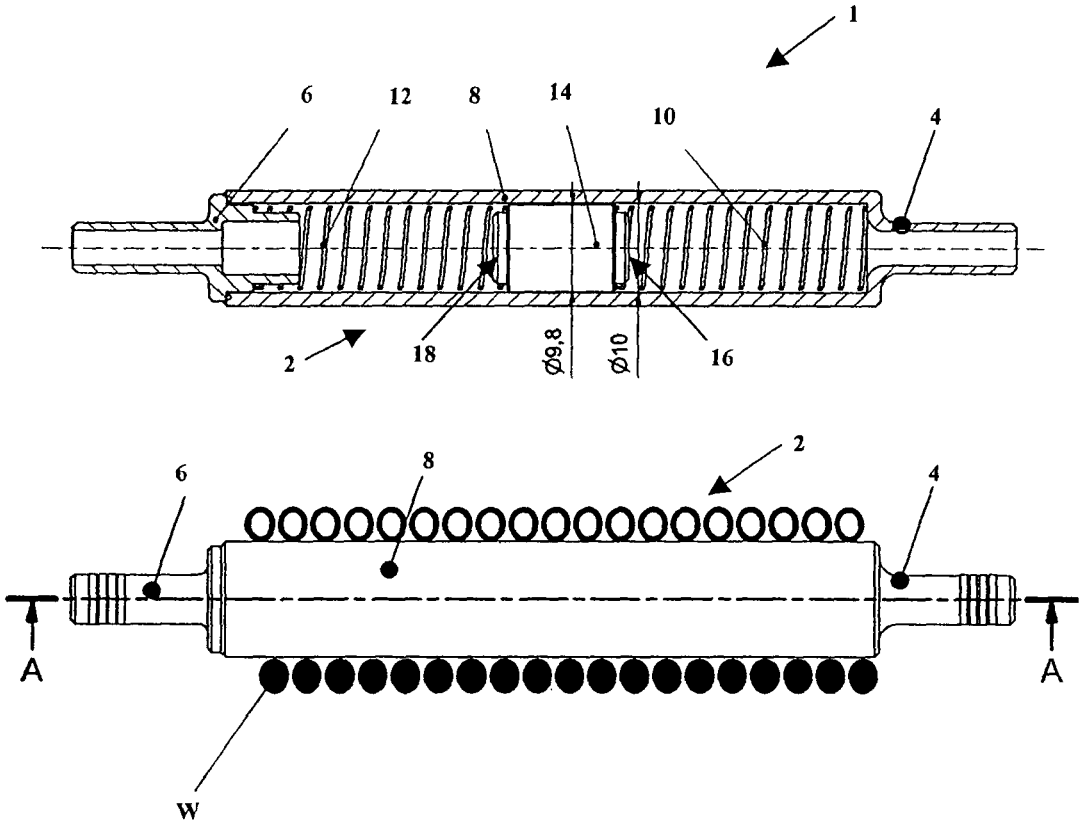
FIG. 10 shows an embodiment of the present invention with electromagnetic detection of movements of the mass.

FIG. 10 shows an embodiment in which movements of the mass 14 are detected electromagnetically. For this, the housing 2 is provided with a winding W which generates a magnetic field in the regions in the housing 2 provided for movements of the mass 14. Furthermore in the case of this embodiment, an at least partially magnetic material is used for the mass 14, in order to be able to generate magnetic field variations in the magnetic field of the winding W upon movements of the mass 14.

In order to provide the damping D, the housing 2 is closed at its first end 4, as a result of which a damping air volume is present between the closed, first end 4 and the mass 14. The second end 6 is open in this case. Alternatively, provision is made whereby movements of the mass 14 are detected by means of one or more Hall sensors.

Figure 11:
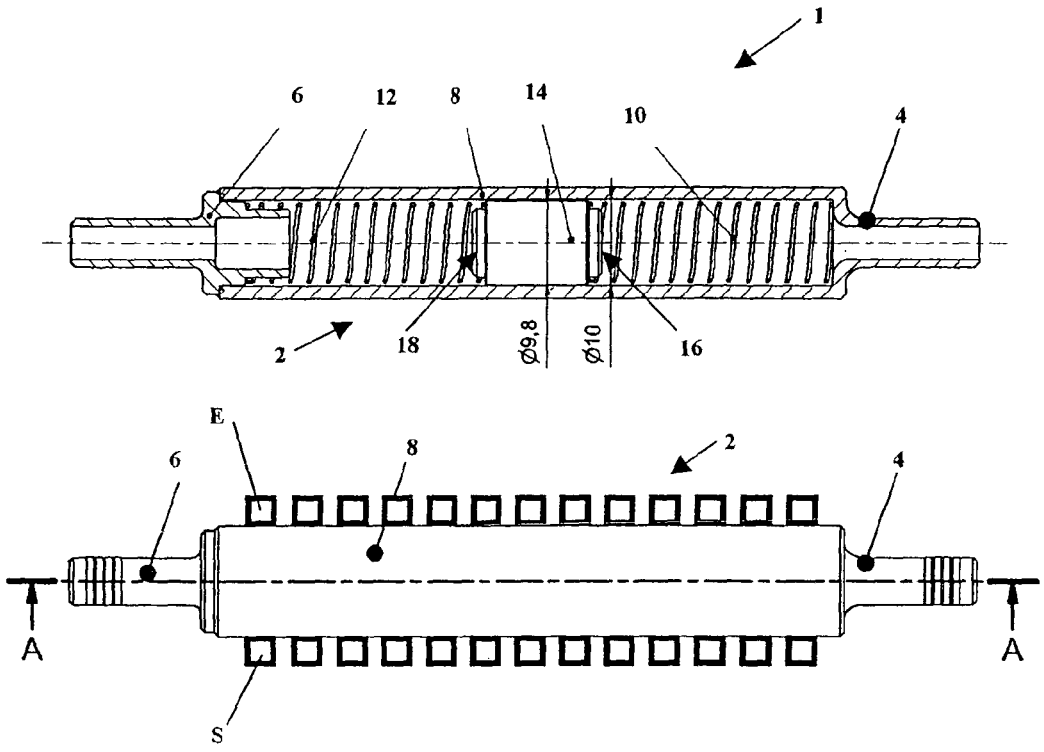
FIG. 11 shows an embodiment of the present invention with optical detection of movements of the mass.

In the case of the embodiment shown in FIG. 11, movements of the mass 14 are detected optically. For this, an optical detection device, comprising a plurality of photoelectric sensors, is used. The individual photoelectric sensors each have a transmitter S and a receiver E. The damping provided in the case of this embodiment corresponds to the damping of the embodiment of FIG. 10.

The invention claimed is:

1. Device for detecting motions of a rotatable component of a domestic appliance that are caused by unbalance, said device having:

a housing (2), a mass (14; M) which is movable in the housing (2) in dependence on motions of the rotatable component that are caused by unbalance, a spring arrangement (10, 12; 22; F) acting upon the mass in order, in the idle state, to hold the mass (14; M) in an initial position, and a fluidic damping (D) acting upon the mass (14; M) in order to damp movements of the mass (14; M) out of the initial position, at least one of the spring arrangement (10, 12; 22; F), the mass (14; M) and the damping (D) being so designed that, above a predefined frequency of motions of the rotatable component that are caused by unbalance of said component, movements of the mass (14; M) out of the initial position are substantially non-dependent on frequency, or frequency-dependent components of movements of the mass (14; M) out of the initial position are within a predefined range, said device further having a motion detection unit for detecting movements of the mass out of the initial position, the motion detection unit comprising a pressure sensor arrangement (42), wherein the device is fluidly coupled with the rotatable component by a fluid line, and wherein the ratio of spring constant of the spring arrangement and mass is selected such that the resonance frequency thereof lies in a lower end of a frequency range of unwanted motions of the rotatable component that are caused by the unbalance.

2. Device according to claim 1, wherein the mass (14; M) is of a predefined form, and the form of the mass (14; M) is so designed that, for a predefined frequency range of motions of the rotatable component that are caused by unbalance, movements of the mass (14; M) out of the initial position are substantially non-dependent on frequency, or frequency-dependent components of movements of the mass (14; M) are within the predefined range.

3. Device according to claim 1, wherein a clearance (20) is provided between the mass (14; M) and a side wall of the housing (2), said side wall extending substantially in parallel to directions of movement of the mass (14; M), and the clearance (20) is so designed that, for a predefined frequency range of motions of the component of the domestic appliance that are caused by unbalance, movements of the mass (14; M) out of the initial position are substantially non-dependent on frequency, or frequency-dependent components of movements of the mass (14; M) are within the predefined range.

4. Device according to claim 1, wherein the predefined frequency is a resonant frequency of the system comprised of spring arrangement, mass and damping.

5. Device according to claim 1, wherein the fluidic damping (D) comprises at least one predefined gas.

6. Device according to claim 1, wherein the fluidic damping (D) comprises at least one predefined fluid.

7. Device according to claim 1, wherein the fluidic damping is provided between a first side of the mass and an input side of the pressure sensor arrangement.

8. Device according to claim 7, wherein a fluid line is disposed between a first, open end of the housing and the input side of the pressure sensor arrangement, said end being opposite the first side of the mass.

9. Device according to claim 7, wherein the pressure sensor arrangement is disposed at a first, open end of the housing, said end being opposite the first side of the mass.

10. Device for detecting motions of a rotatable component of a domestic appliance that are caused by unbalance, said device having:

a housing (2), a mass (14; M) which is movable in the housing (2) in dependence on motions of the rotatable component that are caused by unbalance, a spring arrangement (10, 12; 22; F) acting upon the mass in order, in the idle state, to hold the mass (14; M) in an initial position, and a fluidic damping (D) acting upon the mass (14; M) in order to damp movements of the mass (14; M) out of the initial position, at least one of the spring arrangement (10, 12; 22; F), the mass (14; M) and the damping (D) being so designed that, above a predefined frequency of motions of the rotatable component that are caused by unbalance of said component, movements of the mass (14; M) out of the initial position are substantially non-dependent on frequency, or frequency-dependent components of movements of the mass (14; M) out of the initial position are within a predefined range, wherein the fluidic damping (D) is provided between a first side (16) of the mass (14) and a first, closed end (4) of the housing (2), said end being opposite the first side (16) of the mass (14), wherein the device is fluidly coupled with the rotatable component by a fluid line, and wherein the ratio of spring constant of the spring arrangement and mass is selected such that the resonance frequency thereof lies in a lower end of a frequency range of unwanted motions of the rotatable component that are caused by the unbalance.

11. Device according to claim 10, wherein the housing (2) is open at the second end (6).

12. Device according to claim 10, wherein the fluidic damping comprises at least one predefined gas.

13. Device according to claim 10, wherein the fluidic damping comprises at least one predefined fluid.

14. Device for detecting motions of a rotatable component of a domestic appliance that are caused by unbalance, said device having:

a housing (2), a mass (14; M) which is movable in the housing (2) in dependence on motions of the rotatable component that are caused by unbalance, a spring arrangement (10, 12; 22; F) acting upon the mass in order, in the idle state, to hold the mass (14; M) in an initial position, and a fluidic damping (D) acting upon the mass (14; M) in order to damp movements of the mass (14; M) out of the initial position, at least one of the spring arrangement (10, 12; 22; F), the mass (14; M) and the damping (D) being so designed that, above a predefined frequency of motions of the rotatable component that are caused by unbalance of said component, movements of the mass (14; M) out of the initial position are substantially non-dependent on frequency, or frequency-dependent components of movements of the mass (14; M) out of the initial position are within a predefined range, wherein the housing is open at the second end, and the second end (6) of the housing (2) is designed to be connected to a line (40) of the domestic appliance, said line carrying fluid at least partially and/or at least temporarily, wherein the line is connected with a rotatable component, and wherein the ratio of spring constant of the spring arrangement and mass is selected such that the resonance frequency thereof lies in a lower end of a frequency range of unwanted motions of the rotatable component that are caused by the unbalance.

15. Device according to claim 14, wherein the first spring (10) is fixed to the mass (14; M).

16. Device for detecting motions of a rotatable component of a domestic appliance that are caused by unbalance, said device having:

a housing (2), a mass (14; M) which is movable in the housing (2) in dependence on motions of the rotatable component that are caused by unbalance, a spring arrangement (10, 12; 22; F) acting upon the mass in order, in the idle state, to hold the mass (14; M) in an initial position, and a fluidic damping (D) acting upon the mass (14; M) in order to damp movements of the mass (14; M) out of the initial position, at least one of the spring arrangement (10, 12; 22; F), the mass (14; M) and the damping (D) being so designed that, above a predefined frequency of motions of the rotatable component that are caused by unbalance of said component, movements of the mass (14; M) out of the initial position are substantially non-dependent on frequency, or frequency-dependent components of movements of the mass (14; M) out of the initial position are within a predefined range, wherein the spring arrangement (10, 12; 22; F) comprises a first spring (10) which is disposed between a side (16) of the mass (14; M) and an end (4) of the housing (2), said end being opposite said side, wherein the device is fluidly coupled with the rotatable component by a fluid line, and wherein the ratio of spring constant of the spring arrangement and mass is selected such that the resonance frequency thereof lies in a lower end of a frequency range of unwanted motions of the rotatable component that are caused by the unbalance.

17. Device according to claim 16, wherein the spring arrangement (10, 12; 22; F) comprises a second spring (12) which is disposed between the other side (18) of the mass (14; M) and the other end (6) of the housing (2).

18. Device according to claim 16, wherein the mass (14; M) is held between the first spring (10) and the second spring (12) by non-positive closure.

19. Device according to claim 16, wherein the spring arrangement comprises a spring-extending substantially fully through the housing, and the mass is held in the spring.

20. Device for detecting motions of a rotatable component of a domestic appliance that are caused by unbalance, said device having:

a housing (2), a mass (14; M) which is movable in the housing (2) in dependence on motions of the rotatable component that are caused by unbalance, a spring arrangement (10, 12; 22; F) acting upon the mass in order, in the idle state, to hold the mass (14; M) in an initial position, and a fluidic damping (D) acting upon the mass (14; M) in order to damp movements of the mass (14; M) out of the initial position, at least one of the spring arrangement (10, 12; 22; F), the mass (14; M) and the damping (D) being so designed that, above a predefined frequency of motions of the rotatable component that are caused by unbalance of said component, movements of the mass (14; M) out of the initial position are substantially non-dependent on frequency, or frequency-dependent components of movements of the mass (14; M) out of the initial position are within a predefined range, wherein the spring arrangement (10, 12; 22; F) holds the mass (14; M) biased in the initial position, wherein the device is fluidly coupled with the rotatable component by a fluid line, and wherein the ratio of spring constant of the spring arrangement and mass is selected such that the resonance frequency thereof lies in a lower end of a frequency range of unwanted motions of the rotatable component that are caused by the unbalance.

21. Domestic appliance, having a rotatable drum (28), and a device having a housing (2), a mass (14; M) which is movable in the housing (2) in dependence on motions of the rotatable component that are caused by unbalance, a spring arrangement (10, 12; 22; F) acting upon the mass in order, in the idle state, to hold the mass (14; M) in an initial position, and a fluidic damping (D) acting upon the mass (14; M) in order to damp movements of the mass (14; M) out of the initial position, at least one of the spring arrangement (10, 12; 22; F), the mass (14; M) and the damping (D) being so designed that, above a predefined frequency of motions of the rotatable component that are caused by unbalance of said component, movements of the mass (14; M) out of the initial position are substantially non-dependent on frequency, or frequency-dependent components of movements of the mass (14; M) out of the initial position are within a predefined range, wherein the domestic appliance is a washing machine, and the device is connected to a rising line (40) of the washing machine (24) or constitutes a part of a rising line (40) of the washing machine (24), wherein the device is fluidly coupled with the rotatable component by a fluid line, and wherein the ratio of spring constant of the spring arrangement and mass is selected such that the resonance frequency thereof lies in a lower end of a frequency range of unwanted motions of the rotatable component that are caused by the unbalance.

22. Domestic appliance according to claim 21, having a pressure sensing device (42) for detecting pressures prevailing in the domestic appliance (24), the pressure sensing device (42) also being provided for detecting movements of the mass (14; M) out of the initial position.

23. Domestic appliance according to claim 21, wherein the device is a device further having a motion detection unit for detecting movements of the mass (14; M) out of the initial position and wherein the motion detection unit comprises a pressure sensor arrangement (42)

which is also provided for detecting pressures prevailing in the domestic appliance.

24. Domestic appliance according to claim 21, wherein the domestic appliance is a washing machine (24) or a washer-drier, and the device is attached to a component of the domestic appliance (24), which component can be acted upon by forces, if present, generated by motions of the drum (28) that are caused by unbalance.

* * * * *